US011028742B2

(12) United States Patent
Kanniaraj et al.

(10) Patent No.: US 11,028,742 B2
(45) Date of Patent: Jun. 8, 2021

(54) CRANKCASE VENTILATION SYSTEM FOR AN INTERNAL COMBUSTION ENGINE

(71) Applicant: VOLVO TRUCK CORPORATION, Gothenburg (SE)

(72) Inventors: Nageswaran Kanniaraj, Tiruvarur (IN); Kumaravel Manickam, Bangalore (IN); Mahendran Kasinathan, Villupuram (IN)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/304,204

(22) PCT Filed: May 23, 2017

(86) PCT No.: PCT/EP2017/062353
§ 371 (c)(1),
(2) Date: Nov. 23, 2018

(87) PCT Pub. No.: WO2017/207335
PCT Pub. Date: Dec. 7, 2017

(65) Prior Publication Data

US 2020/0141293 A1 May 7, 2020

(30) Foreign Application Priority Data

Jun. 1, 2016 (IN) ..... 201641018781

(51) Int. Cl.
*F01M 13/04* (2006.01)
*F01M 13/00* (2006.01)
*F01M 13/02* (2006.01)

(52) U.S. Cl.
CPC ..... *F01M 13/04* (2013.01); *F01M 2013/0072* (2013.01); *F01M 2013/0083* (2013.01);
(Continued)

(58) Field of Classification Search
CPC ..... F01M 2013/0411; F01M 13/04; F01M 2013/0072; F01M 2013/0083; F01M 2013/026; F01M 2013/0438
See application file for complete search history.

(56) References Cited

U.S. PATENT DOCUMENTS 3,509,967 A * 5/1970 Ballard ..... F01M 13/04 184/6.24
3,533,385 A * 10/1970 Bennett ..... F02M 35/08 123/573

(Continued)

FOREIGN PATENT DOCUMENTS

DE 10019836 A1 11/2000
EP 1985355 A1 10/2008

(Continued)

OTHER PUBLICATIONS

Terashita, JP H05-44424, machine translation. (Year: 1993).*

(Continued)

*Primary Examiner* — Hung Q Nguyen
*Assistant Examiner* — Mark L. Greene
(74) *Attorney, Agent, or Firm* — Venable LLP; Jeffri A. Kaminski

(57) ABSTRACT

A crankcase ventilation system is provided for an internal combustion engine that includes a crankcase. An internal combustion engine including such a system is also provided.

23 Claims, 5 Drawing Sheets

(52) U.S. Cl.
CPC ..... *F01M 2013/026* (2013.01); *F01M 2013/0411* (2013.01); *F01M 2013/0438* (2013.01)

(56) References Cited

U.S. PATENT DOCUMENTS

| | | | | |
|---|---|---|---|---|
| 5,863,317 | A * | 1/1999 | Smith | B01D 45/14 55/409 |
| 6,047,670 | A * | 4/2000 | Stella | F01M 13/04 123/41.86 |
| 7,562,652 | B2 | 7/2009 | Homes et al. | |
| 7,988,860 | B2 * | 8/2011 | Kalayci | B01D 39/1623 210/502.1 |
| 2008/0149082 | A1 * | 6/2008 | Heed | F01M 13/04 123/573 |
| 2009/0065436 | A1 | 3/2009 | Kalayci et al. | |
| 2009/0199794 | A1 | 8/2009 | Slaughter et al. | |
| 2014/0048052 | A1 * | 2/2014 | Subedi | F01M 13/04 123/572 |
| 2014/0059985 | A1 * | 3/2014 | Janakiraman | B01D 45/08 55/459.4 |

FOREIGN PATENT DOCUMENTS

| | | | | |
|---|---|---|---|---|
| EP | 2311542 | A1 | | 4/2011 |
| FR | 2332424 | A1 | | 6/1977 |
| GB | 230135 | A | | 1/1997 |
| JP | 05044424 | A | * | 2/1993 |
| JP | 10299450 | A | * | 11/1998 |
| WO | 2015108853 | A1 | | 7/2015 |

OTHER PUBLICATIONS

Ozaki, JP H10-299450, machine translation (Year: 1998).*
International Search Report (dated Sep. 4, 2017) for corresponding International App. PCT/EP2017/082353.
China Office Action dated Jul. 16, 2020, in corresponding China Application No. 201780033477.1, 19 pages.
European Office Action dated Feb. 24, 2020 in corresponding EP Application No. 17727151.7, 6 pages.
India Office Action dated Jan. 31, 2021 in corresponding India Patent Application No. 201641018781, 7 pages.

* cited by examiner

CRANKCASE VENTILATION SYSTEM FOR AN INTERNAL COMBUSTION ENGINE

BACKGROUND AND SUMMARY

The present invention relates to a crankcase ventilation system for an internal combustion engine comprising a crankcase. The invention also relates to an internal combustion engine comprising such a device.

When operating an internal combustion engine, it is necessary to handle the small amount of gases leaking past the piston rings of the cylinder and into a crankcase of the engine. The crankcase gas may in some applications be vented to the atmosphere, or as an alternative the crankcase gas may be fed back into the intake manifold, to re-enter the combustion chamber as part of a fresh charge of air and fuel.

However, before re-entering the combustion chamber or entering the atmosphere, the crankcase gas is typically cleaned, allowing for removal of small particles, solid and/or liquid, suspended in the crankcase gas. Different types of crankcase ventilation systems have been proposed, including passive type crankcase ventilation systems comprising some form of filter member or active type crankcase ventilation system including for example a centrifugal separator.

An exemplary passive type crankcase ventilation system is disclosed in U.S. Pat. No. 7,562,652. In U.S. Pat. No. 7,562,652, a hydrophobic, oleophobic membrane is used as the filter member for separating oil droplets from the crankcase gas before the crankcase gas exit the crankcase. The membrane allows air and other vapors to pass but separates the oil droplets out for return to the crankcase thus reducing oil loss through the crankcase emission control system.

An exemplary active type crankcase ventilation system is disclosed in EPI532353B1. In EP 1532353B1, solid and/or liquid particles are separated out from the crankcase gas. The separator has a conical rotor that is formed to a plate stack and is situated in a thereto provided housing, where the conical rotor is set into rotation by an electric motor. The crankcase gas that is to be cleaned enters the housing axially and flows through the rotor in the direction from radially inner to radially outer. The separated-out particles contact the inner surface of a circumferential wall of the housing of the centrifugal separator, and from there they are led downward by the action of gravity, to a separate outlet. The cleaned gas flows upward in the axial direction, to a cleaned gas outlet provided there.

The passive type crankcase ventilation systems will typically comprise less moving parts as compared to the active type crankcase ventilation systems, thus making the active type crankcase ventilation systems more prone to failure. On the other hand, the passive type crankcase ventilation systems may in some situations introduce an undesirable pressure drop of the crankcase gas, e.g. due to accumulation of contaminants at a surface of the filter member. In view of the above, there seems to be room for further improvements of crankcase ventilation systems provided for crankcase gas cleaning.

According to an aspect of the invention, the above is at least partly alleviated by a crankcase ventilation system for an internal combustion engine comprising a crankcase, the system comprising a first filter arrangement arranged for cleaning a crankcase gas generated during operation of the engine, wherein the system comprises a device for altering a temperature of the crankcase gas towards a desired temperature, at which the first filter arrangement is adapted for an efficient cleaning.

By means of the inclusion of a temperature altering device with the crankcase ventilation system, it is possible to adapt a temperature of the crankcase gas such that the first filter arrangement is allowed to operate where an effective level of cleaning of the crankcase gas is made possible, where the temperature may be targeted to the specific type of first filter arrangement.

Preferably, the first filter arrangement comprises a filter element for cleaning the contaminated crankcase gas. When a filter element is comprised with the first filter arrangement and adapted for cleaning of the crankcase gas, the temperature of the crankcase gas may for example be adapted such that the above mentioned undesirable pressure drop is achieved.

In an embodiment, the filter element is of an oleophobic type, preferably of a hydrophobic type, arranged to inhibit the passage of liquid contaminants comprised with the crankcase gas. An advantage of using such a filter element is that this type of filter element is less affected by liquid contaminants as compared to e.g. filter element comprising woven filter media, when it comes to accumulation of the contaminants at the surface of the filter element.

In a preferred embodiment the filter element is of an expanded oleophobic type. An advantage of using a filter element of the expanded oleophobic type as compared to the "non-expanded" oleophobic type of filter element as exemplified in above mentioned U.S. Pat. No. 7,562,652 is that an expanded oleophobic type filter element may be specifically arranged to have a customized expansion ratio that will help to balance the back pressure and venting requirements of the crankcase ventilation system. This is made possible since the expanded oleophobic type filter element may be provided with more even micro pore sizes as compared to the non-expanded oleophobic type of filter element.

In an embodiment the expanded oleophobic type filter element may be arranged as a membrane, for example manufactured from a modified acrylic copolymer cast on a thin, non-woven polyester support that is treated with an oleophobic/hydrophobic substance or a modified polyethersulfone polymer cast on a non-woven polyester support treated with an oleophobic/hydrophobic substance. Examples of such oleophobic/hydrophobic substances include fluoropolymers such as a fluorosulfone (e.g., polyfluorosulfone acrylate), a polyvinylidene fluoride, a polytetrafluoroethylene (PTFE), and most preferably an Expanded Polytetrafluoroethylene (ePTFE). In a specific embodiment a porosity of the membrane is at least 80%.

In an embodiment, the temperature altering device is adapted for controlling the temperature of the crankcase gas towards the desired temperature, preferably for cooling the crankcase gas. Cooling of the crankcase gas to a desired temperature, selected based on the type of filer element has shown to be advantageous, specifically where the filter element is of the expanded oleophobic type.

The temperature control may be provided using at least one or a combination of active and passive means. In an embodiment the temperature altering device comprises a first conduit arranged for connection to the crankcase at a first end and to the first filter arrangement at a second end, where for example the first conduit may be configured for active cooling of the crankcase gas flowing through the first conduit, for example using a fan. Alternative or also, the first conduit is configured for passive cooling of the contaminated crankcase gas flowing through the first conduit, for example by arranging the first conduit on a cool side of the engine.

In an embodiment, the temperature altering device further comprises a control unit and a temperature sensor, where the temperature sensor is electrically connected to the control unit and configured to measure a temperature of the crankcase gas. The control unit is further configured for comparing the sensed temperature with a predetermined threshold and to generate a control signal if the sensed temperature is above the predetermined threshold. Advantages with this embodiment includes the possibility of only cooling the crankcase gas once the temperature of the crankcase gas has reached a predefined temperature level (the predetermined threshold), thereby also ensuring that the temperature of the crankcase gas is kept high enough such that operation of the engine in e.g. winter conditions does not introduce possible icing problems due to water vapor comprised with the crankcase gas. This may for example be achieved by arranging the temperature altering device to further comprise a heat exchanger, preferably operatively connected with a cooling system of the engine. The heat exchanger may for example be operated/activated based on the mentioned control signal.

In an embodiment the filter element is arranged to have at least one of a spherical or a cylindrical form, preferably with a surface area of the filter element being at least 0.01 m2, preferably at least 0.015 m2. With the suggested form and surface area, in combination with the temperature altering device, an improved cleaning of the crankcase gas may be achieved while at the same time keeping the pressure drop below a desired pressure drop threshold. As mentioned above, when the filter element is of the expanded oleophobic type it is preferably arranged as a membrane. The membrane, when arranged in the spherical or the cylindrical form, is preferably arranged within a housing comprised with the first filter arrangement.

In a possible embodiment, the crankcase ventilation system further comprises a second filter arrangement corresponding to the first filter arrangement, wherein the second filter arrangement is arranged in series with the first filter arrangement, downstream of the first filter arrangement. Advantages with such an implementation is the possibility of further improving the cleaning of the crankcase gas, or for allowing the filter element provided with each of the first and the second filter arrangement to be selected to give an in comparison lower pressure drop as the cleaning may be split between the two filter arrangements. It may of course be possible to include more than a second filter arrangement with the disclosed crankcase ventilation system.

The first filter arrangement may be provided with a crankcase gas outlet, where the crankcase gas outlet of the first filter arrangement is connected to a crankcase gas inlet comprised with the second filter arrangement. Correspondingly, the first filter arrangement may be configured to comprise a crankcase gas inlet, typically connected to the first conduit as discussed above. A crankcase gas outlet may also be comprised with the second filter arrangement. As mentioned above, the first and the second filter arrangement may each comprise a housing, each housing comprising the mentioned gas inlet and gas outlet.

In an embodiment, the first (and also the second) filter arrangement further comprises a contaminant outlet provided at the housing and configured to release contaminants to an oil sump comprised with the engine. The contaminant outlet is preferably arranged at the mentioned housing. Accordingly, as the contaminants typically include oil droplets from the engine, they are thus allowed to be re-entered to the engine.

In a possible embodiment, the crankcase ventilation system is configured to recirculate the crankcase gas through the first filter arrangement. For example, if it is determined (e.g. by means of a thereto included sensor connected to the above mentioned control unit) that the crankcase gas has not been sufficiently cleaned; the crankcase gas may once again be allowed to pass through the first filter arrangement. This may for example be achieved using a controllable valve mechanism configured to adjust a level of crankcase gas recirculation based on a crankcase gas pressure. Possibly, the valve mechanism may be configured to be controlled based on a crankcase gas pressure in the crankcase.

In a possible embodiment, the crankcase ventilation system further comprises a fan configured to control a flow of the crankcase gas flowing through the first filter arrangement. Accordingly, such an implementation may further allow for the pressure drop of the crankcase gas to be minimized, or at least controlled to be within a desired range.

The crankcase ventilation system preferably forms part of an internal combustion engine. The internal combustion engine may in turn form part of a power train. The powertrain is preferably arranged in a vehicle, such as a heavy-duty vehicle, specifically in relation to a truck, a bus or any form of construction equipment.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
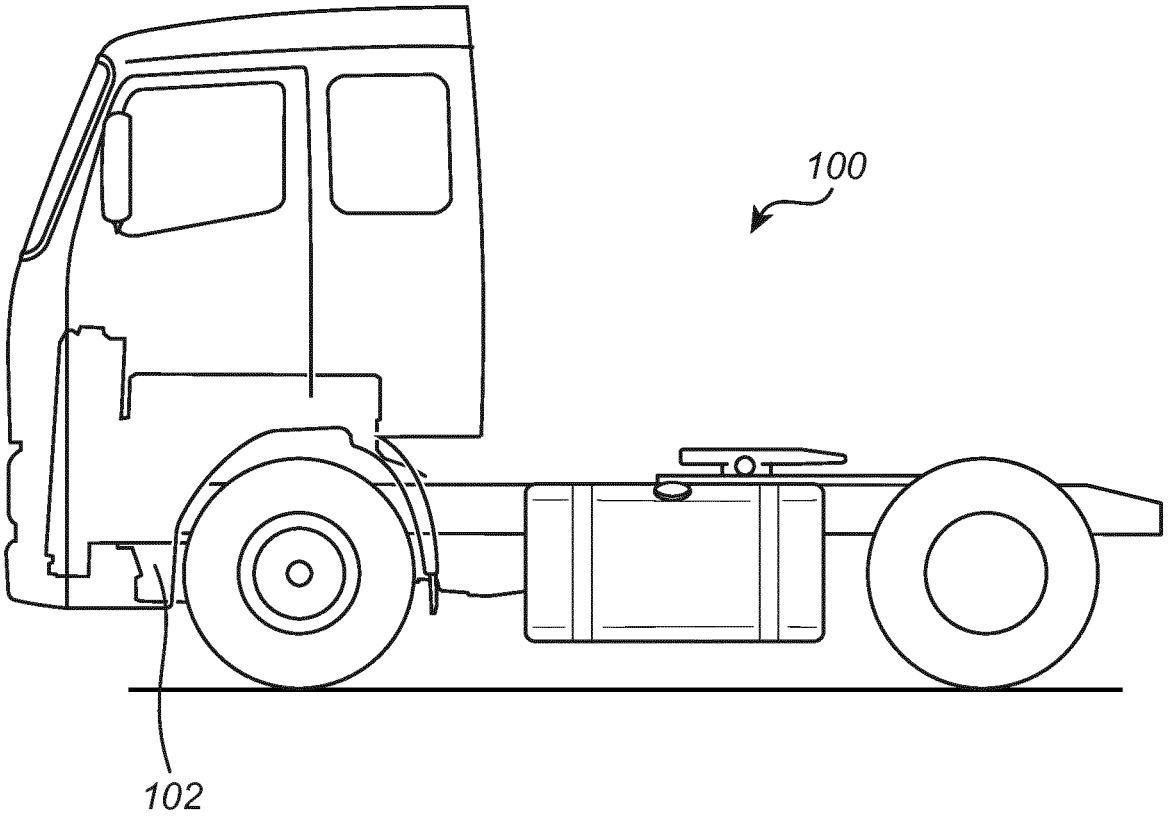
FIG. 1 illustrates a vehicle equipped with an internal combustion engine according to the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted an exemplary vehicle, here illustrated as a truck 100. The truck 100 is provided with a source of motive power 102 for propelling the truck via a driveline connecting the power source to the wheels. The power source 102 is constituted by an internal combustion engine (ICE) in the form of a diesel engine. It will in the following for ease of presentation be referred to as an internal combustion engine 102.

Figure 2:
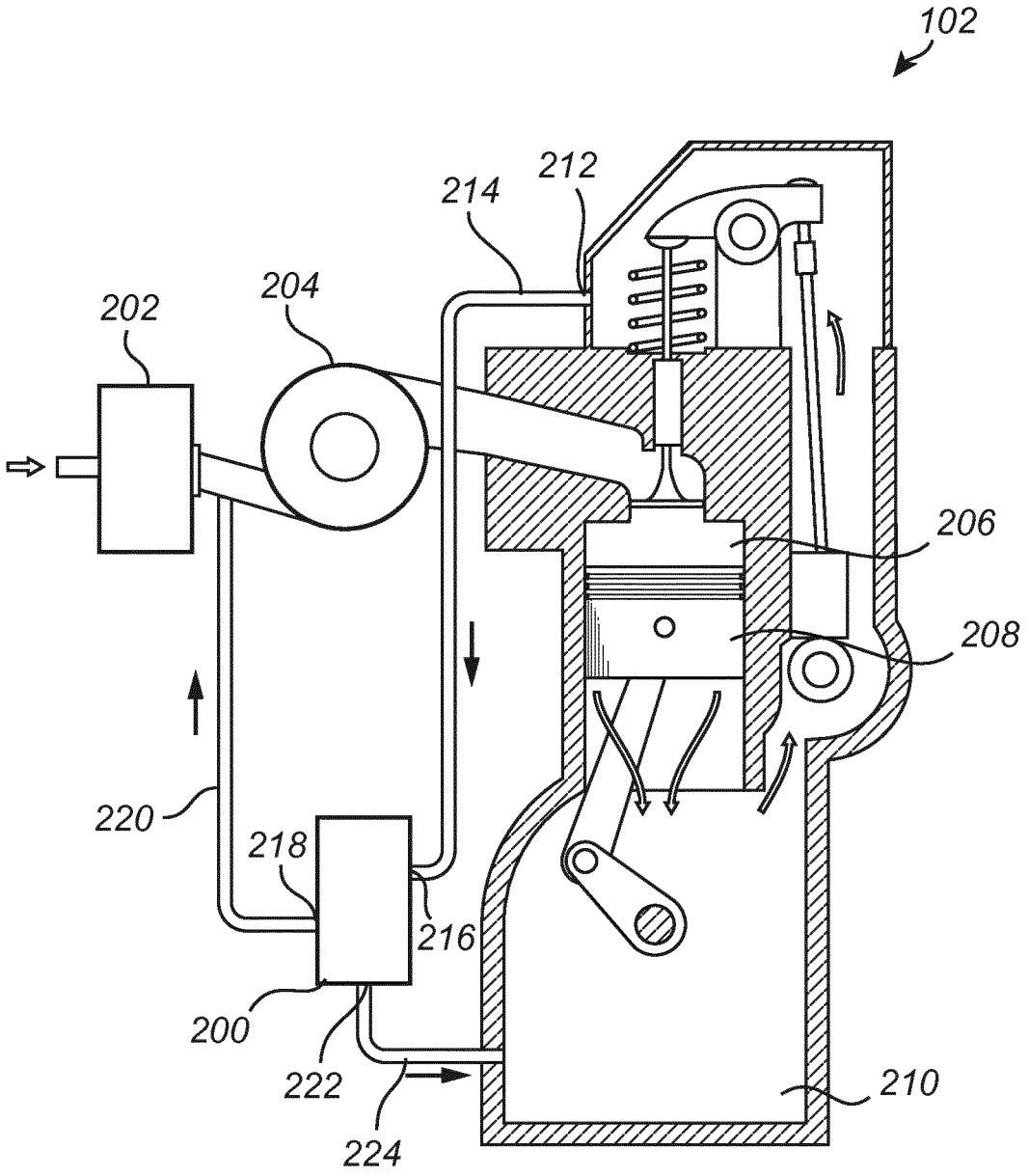
FIG. 2 conceptually illustrates an internal combustion engine equipped with a crankcase ventilation system.

FIG. 2 shows the internal combustion engine 102 equipped with a crankcase ventilation system 200 according to the invention.

During use of the ICE 102, ambient air will be drawn though an air filter 202, pass a turbo 204 and into an upper part of a cylinder 206, above a piston 208, where it will be mixed with a fuel, such as for example diesel or petrol. As the air/fuel mixture in the cylinder 206 is ignited, portions of the combustion gases will leak past the sides of the piston 208 (past piston ring(s) of the piston) and into a crankcase 210 comprised with the ICE 102.

The combustion gases entering the crankcase 210 comprise contaminants, such as for example soot particles. The combustion gases will further come in contact with and be partly mixed with further contaminants comprised in the crankcase 210, such as oil, forming a contaminated crankcase gas. A pressure formed by the combustion gases entering the crankcase 210 needs to be vented in a controlled manner, in accordance to the present disclosure through the crankcase ventilation system 200. The crankcase gas is allowed to exit the crankcase 210 through an outlet 212, for example arranged at an upper portion of the ICE 102, other placements of such an outlet is of course possible and within the scope of the invention.

A first conduit 214 is provided for transporting the crankcase gas from the outlet 212 of the ICE 102 to an inlet 216 of the crankcase ventilation system 200. The crankcase gas is cleaned inside of the crankcase ventilation system 200, as will be further discussed below, and a cleaned crankcase gas will be released through a first outlet 218 of the crankcase ventilation system 200. A fan function may be provided inside of and/or outside of the crankcase ventilation system 200 for assisting the transportation of the crankcase gas through the crankcase ventilation system 200. The cleaned crankcase gas may for example, as illustrated in FIG. 2, be mixed with ambient air before entering the turbo 204. A second conduit 220 may be provided for connecting the first outlet 218 of the crankcase ventilation system 200 to the turbo 204. Alternatively, the cleaned crankcase gas may be allowed to enter the atmosphere, possibly passing through further filters members before doing so.

The contaminants/particles having been removed from the contaminated crankcase gas are preferably passed back to an oil sump comprised with the ICE 102 through a second outlet 222 of the crankcase ventilation system 200 and by a third conduit 224. Furthermore, it should be noted that it is desirable to arrange some form of check valve (one-way valve) functionality between the second outlet 222 of the crankcase ventilation system 200 and the crankcase 210, thereby only allowing contaminants to be passed back to the crankcase 210 and not allowing contaminated crankcase gases to be sucked "backwards" into the crankcase ventilation system 200.

Figure 3A:
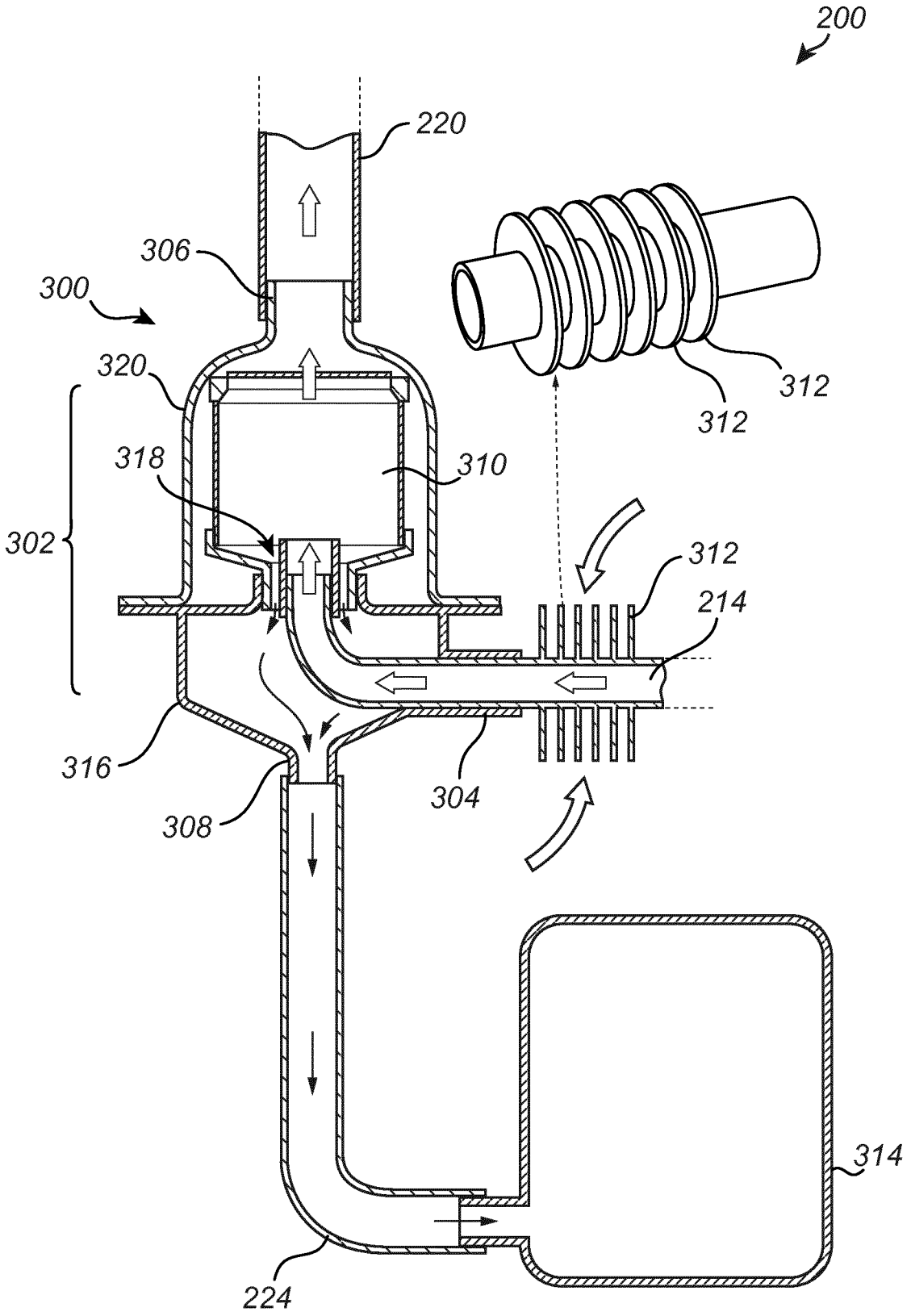
FIGS. 3*a* and 3*b* conceptually illustrates a first and a second embodiment of the crankcase disclosed ventilation system, and FIGS. 4*a* and 4*b* conceptually illustrates a first and a second currently preferred embodiment of a filter element comprised with the crankcase ventilation system.

Turning now to FIG. 3*a*, which illustrates an exemplary embodiment of a single stage crankcase ventilation system 200 that may be used together with the ICE 102. In the illustrated embodiment, the crankcase ventilation system 200 comprises a first filter arrangement 300. The first filter arrangement 300 in turn comprises a housing 302 having a gas inlet 304 and a gas outlet 306. The first conduit 214 is arranged to be connected to the gas inlet 304 and the second conduit 220 is arranged to be connected to the gas outlet 306. The housing 302 further comprises a contaminant outlet 308 arranged to be connected to the third conduit 224.

The first filter arrangement 300 further comprises a filter element in the form of an expanded oleophobic membrane 310 formed as a cylinder, further discussed below in relation to FIGS. 4*a* and 4*b*.

In addition, the crankcase ventilation system 200 further comprises a passive temperature altering device, in the illustrated embodiment implemented by means of heat flanges 312 arranged together with the first conduit 214.

During operation of the crankcase ventilation system 200, the crankcase gas will be sucked from the crankcase, by the outlet 212 and through the first conduit 214. When passing the first conduit 214, ambient air for example by the first conduit 214 being arranged on a cold side of the ICE 102 (completely passive cooling) or in the vicinity of a fan (not shown, providing semi-passive cooling) comprised with the ICE 102 will alter the temperature of the crankcase gas, before the crankcase gas reaches the first filter arrangement 300. The design of the heat flanges 312 may for example be selected such that the crankcase gas once reaching the first filter arrangement 300 has a desired temperature essentially matches a filtration temperature of the expanded oleophobic membrane 310 where the cleaning of the crankcase gas reaches is performed as is desired for the specific implementation. The temperature of the crankcase gas may for example be altered such that the amount of contaminants adhering to an inside surface of the expanded oleophobic membrane 310 is reduced, and/or such that a gas flow through the expanded oleophobic membrane 310 is kept above a predetermined threshold. In an embodiment, the heat flanges 312 are implemented such that the temperature of the crankcase gas is between 250-320 degrees C. once the crankcase gas reaches the first filter arrangement 300.

Once the crankcase gas reaches the first filter arrangement 300, the expanded oleophobic membrane 310 will inhibit the passage of e.g. liquid contaminants comprised with the crankcase gas. The liquid contaminants will accordingly "stay on the inside" of the cylindrically formed expanded oleophobic membrane 310. The non-sticky properties of the expanded oleophobic membrane 310 will together with gravitation then force the liquid contaminants towards a downward pointing conical bottom section 316 of the housing 302 of the first filter arrangement 300, eventually reaching the contaminant outlet 308, to subsequently reach the oil sump 314 of the ICE 102, for further use during operation of the ICE 102.

In the illustrated embodiment the gas inlet 304 of the first filter arrangement 300 is further provided with a passage 318, allowing the liquid contaminants to pass downward to the bottom section 316 of the housing 302. The passage 318 is arranged to at least partly encircle the gas inlet 304 of the housing 302.

In the illustrated embodiment the housing 302 comprises the mentioned bottom section 316 and a top section 320. In a possible embodiment of the invention the bottom section 316 and the top section 320 may be separated (i.e. detachably connected), allowing the expanded oleophobic membrane 310 to be exchanged once its lifetime has passed, e.g. when performing service of the ICE 102. Alternatively, all of the first filter arrangement is exchanges once the crankcase ventilation system 200 is serviced.

Figure 3B:
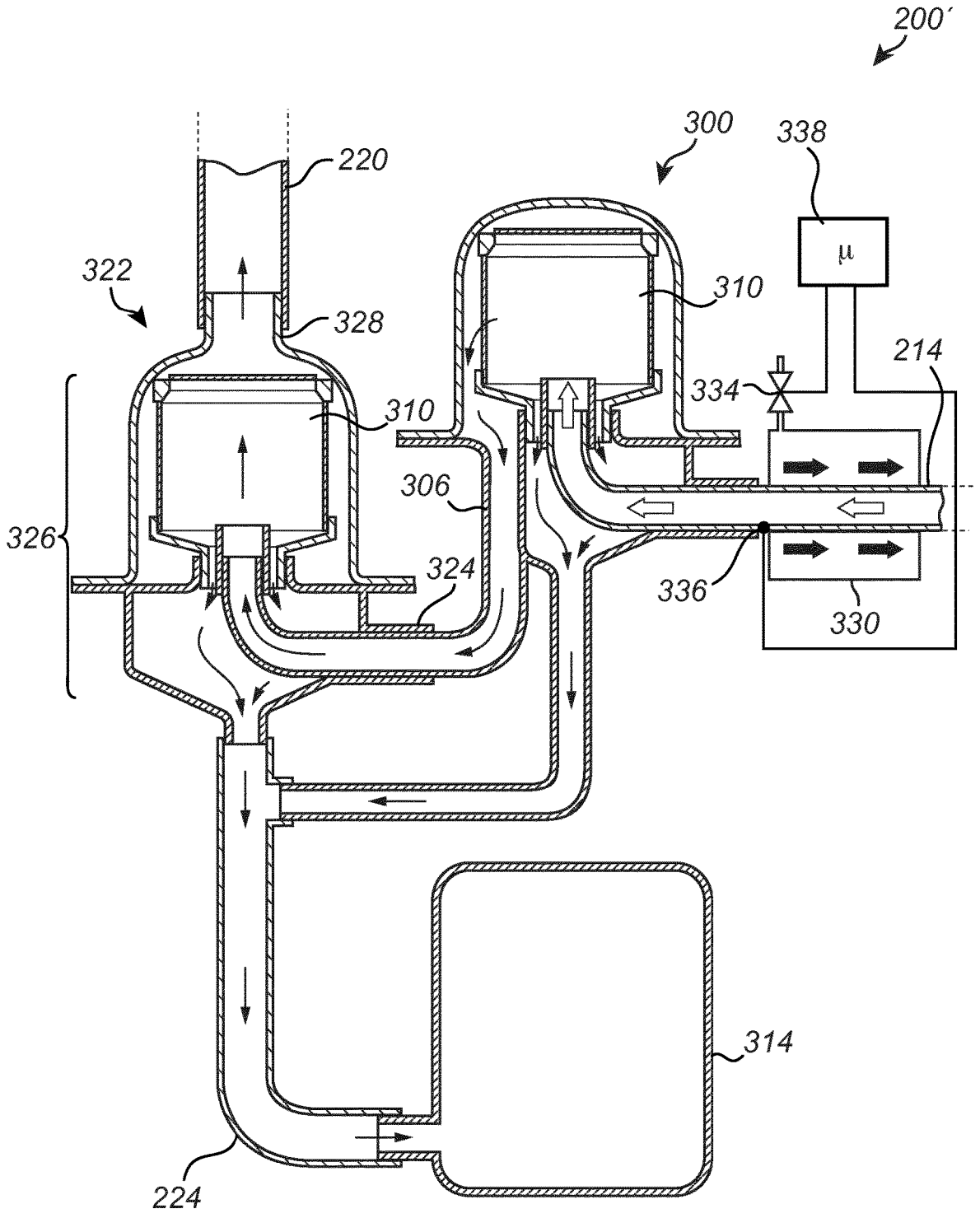

Turning now to FIG. 3*b*, which illustrates an alternative exemplary embodiment of the crankcase ventilation system 200, here presented in the form of a multi-stage crankcase ventilation system 200'. In addition to the first filter arrangement 300 comprised with the single stage crankcase ventilation system 200 shown in FIG. 3*a*, the multi-stage crankcase ventilation system 200' further comprises a second filter arrangement 322 corresponding to the first filter arrangement 300, wherein the second filter arrangement 322 is arranged in series with the first filter arrangement 300, downstream of the first filter arrangement 300.

Preferably, the second filter arrangement 322 is arranged such that the gas outlet 306 of the first filter arrangement 300 is connected to a gas inlet 324 of the second filter arrangement 322, comprised with a housing 326 of the second filter arrangement 322. The second filter arrangement 322 further comprises a gas outlet 328 connected to the second conduit 220. The second filter arrangement 322 further comprises a corresponding expanded oleophobic membrane 310 as comprised with the first filter arrangement 300.

As mentioned, the crankcase ventilation system 200 shown in FIG. 3*a* comprises a passive temperature altering device. In comparison, the crankcase ventilation system 200' shown in FIG. 3*b* is provided with an active temperature altering device, implemented by means of a heat exchanger 330. In the illustrated embodiment, the heat exchanger 330 is arranged with the first conduit 214, such that the crankcase gas is allowed to flow through the heat exchanger 330. The heat exchanger 330 is in turn connected to e.g. a cooling circuit (not shown) of the ICE 102. The flow of a coolant flowing through the heat exchanger 330 may be controlled by e.g. a valve 334 provided with the heat exchanger 330.

During operation of the crankcase ventilation system 200' shown in FIG. 3*b*, a temperature of the crankcase gas may be monitored, for example using a temperature sensor 336 arranged at a vicinity to the gas inlet 324. A control unit 338 may for example be arranged to sample a signal from the temperature sensor 336, determine a temperature of the crankcase gas and comparing the determined temperature with a predetermined threshold. In case the temperature is outside of a predetermined threshold/temperature range (e.g. the above mentioned 250-320 degrees C.), the valve 334 may be controlled for increasing or decreasing the flow of the coolant flowing through the heat exchanger 330, thereby altering the temperature of the crankcase gas towards the desired temperature/temperature range. It could also be possible to allow a heated fluid to be circulated through the heat exchanger 330, thereby allowing the crankcase gas to be heated towards the desired temperature.

As mentioned above, by means of introducing the second filter arrangement 322, it may be possible to adapt e.g. parameters of the expanded oleophobic membrane 310, for example allowing a higher pass-through, providing less reduction of a pressure drop of the crankcase gas with e.g. the same level of cleaning of the crankcase gas. Alternatively, an increased cleaning of the crankcase gas may be implemented as the crankcase gas has to pass through two separate and essentially identical filter arrangements.

It should be understood that it also may be possible to alternatively arrange the first filter arrangement 300 in parallel with the second filter arrangement 322. Such an implementation could allow for improved redundancy. In addition, liquid contaminants from both the first 300 and the second 322 filter arrangements may both be collected within the oil sump 314.

Figure 4A:
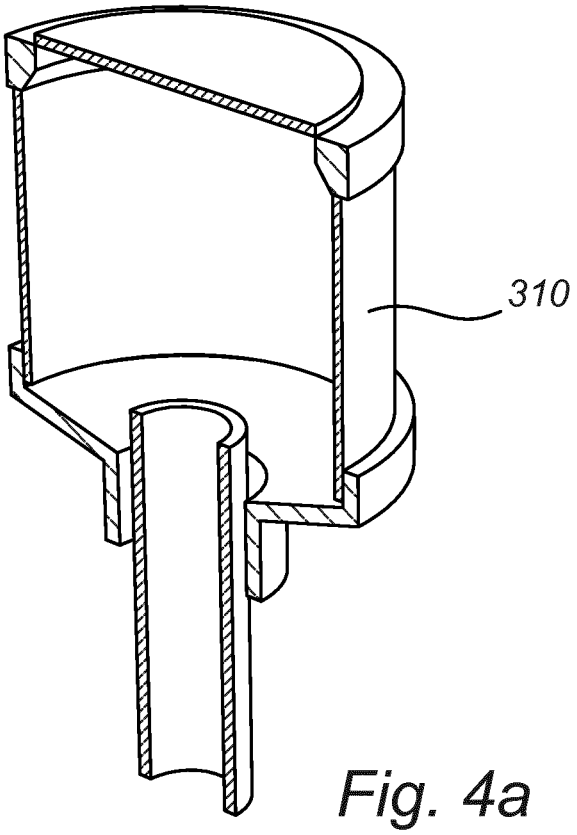
Figure 4B:
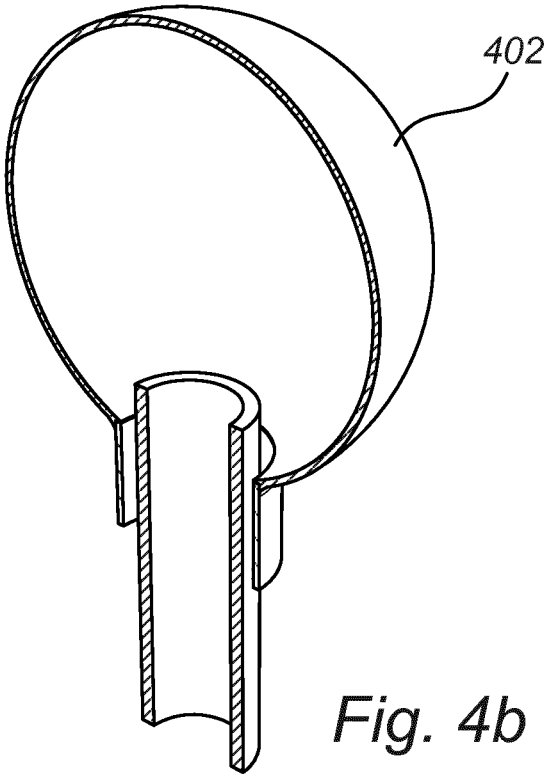

Turning finally to FIGS. 4*a* and 4*b*, conceptually illustrates a first and a second currently preferred embodiment of a filter element comprised with the crankcase ventilation system.

In the first embodiment of the filter element as shown in FIG. 4*a*, the filter element is arranged as the cylindrically formed expanded oleophobic membrane 310, for example shown in FIGS. 3*a* and 3*b*.

In the second embodiment of the filter arrangement as shown in FIG. 4*b*, the filter element is arranged as a spherical formed expanded oleophobic membrane 402. The form of the filter element is typically depending on the implementation at hand, and possible real-estate constraints posed when implementing the ICE 102 with the truck 100. In any case and as mentioned above, it is desirable to select the form such that a surface area is large enough for only imposing a smaller pressure drop to the crankcase gas. In a specific embodiment the surface area of the filter element is at least 0.01 m2, preferably at least 0.015 m2.

In summary, the present invention relates to a crankcase ventilation system for an internal combustion engine comprising a crankcase, the system comprising a first filter arrangement arranged for cleaning a crankcase gas generated during operation of the engine, wherein the system comprises a device for altering a temperature of the crankcase gas towards a desired temperature, at which the first filter arrangement is adapted for an efficient cleaning.

By means of the inclusion of a temperature altering device with the crankcase ventilation system, it is possible to adapt a temperature of the crankcase gas such that the first filter arrangement is allowed to operate where an effective level of cleaning of the crankcase gas is made possible, where the temperature may be targeted to the specific type of first filter arrangement.

Even though the present disclosure has been described with reference to specific exemplifying embodiments thereof, many different alterations, modifications and the like will become apparent for those skilled in the art from a study of the drawings, the disclosure, and the appended claims. In addition, in the claims, the word "comprising" does not exclude other elements or steps, and the indefinite article "a" or "an" does not exclude a plurality.

The invention claimed is:

1. A crankcase ventilation system for an internal combustion engine comprising a crankcase, the crankcase ventilation system comprising:

a first filter arrangement arranged for cleaning a crankcase gas generated during operation of the internal combustion engine, the first filter arrangement comprising a filter element of an oleophobic type for cleaning the crankcase gas, a temperature altering device for cooling a temperature of the crankcase gas towards a desired temperature, at which the first filter arrangement is adapted for an efficient cleaning, wherein:

the temperature altering device comprises a control unit and a temperature sensor, the temperature sensor is electrically connected to the control unit and configured to measure a temperature of the crankcase gas, and the control unit is configured for comparing the measured temperature with a predetermined threshold and to generate a control signal if the measured temperature is above the predetermined threshold.

2. The crankcase ventilation system according to claim 1, wherein the filter element is of an expanded oleophobic type.

3. The crankcase ventilation system according to claim 2, wherein a porosity of the filter element is at least 80%.

4. The crankcase ventilation system according to claim 1, wherein the temperature altering device comprises a first conduit arranged for connection to the crankcase at a first end and to the first filter arrangement at a second end.

5. The crankcase ventilation system according to claim 4, wherein the first conduit is configured for active cooling of the crankcase gas flowing through the first conduit.

6. The crankcase ventilation system according to claim 4, wherein the temperature altering device comprises a fan for cooling the crankcase gas, and wherein the first conduit is arranged for being subjected to an air flow produced by the fan.

7. The crankcase ventilation system according to claim 4, wherein the temperature altering device comprises a means arranged to circulate a coolant in proximity to the first conduit for cooling of the crankcase gas flowing through the first conduit.

8. The crankcase ventilation system according to claim 4, wherein the first conduit is configured for passive cooling of the crankcase gas flowing through the first conduit.

9. The crankcase ventilation system according to claim 4, wherein the first conduit is arranged on a cool side of the internal combustion engine.

10. The crankcase ventilation system according to claim 1, wherein the temperature altering device comprises a fan for cooling the crankcase gas.

11. The crankcase ventilation system according to claim 1, wherein the temperature altering device further comprises a heat exchanger operatively connected with a cooling system of the internal combustion engine.

12. The crankcase ventilation system according to claim 1, wherein the filter element is arranged to have a cylindrical form.

13. The crankcase ventilation system according to claim 1, wherein a surface area of the filter element is at least 0.01 m2.

14. The crankcase ventilation system according to claim 1, further comprising a second filter arrangement corresponding to the first filter arrangement, wherein the second filter arrangement is arranged in series with the first filter arrangement, downstream of the first filter arrangement.

15. The crankcase ventilation system according to claim 14, wherein a crankcase gas outlet comprised with the first filter arrangement is connected to a crankcase gas inlet comprised with the second filter arrangement.

16. The crankcase ventilation system according to claim 1, wherein the first filter arrangement further comprises a contaminant outlet provided at a housing and configured to release contaminants to an oil sump comprised with the internal combustion engine.

17. The crankcase ventilation system according to claim 1, further comprising a fan configured to control a flow of the crankcase gas flowing through the first filter arrangement.

18. An internal combustion engine including a crankcase and further comprising the crankcase ventilation system according to claim 1.

19. A vehicle comprising the internal combustion engine according to claim 18.

20. The crankcase ventilation system according to claim 1, wherein the temperature altering device is adapted to cool the crankcase gas to between 250-320 degrees C. once the crankcase gas reaches the first filter arrangement.

21. A crankcase ventilation system for an internal combustion engine comprising a crankcase, the crankcase ventilation system comprising:

a first filter arrangement arranged for cleaning a crankcase gas generated during operation of the internal combustion engine, the first filter arrangement comprising a filter element of an oleophobic type for cleaning the crankcase gas, a temperature altering device for cooling a temperature of the crankcase gas towards a desired temperature, at which the first filter arrangement is adapted for an efficient cleaning, wherein the filter element is arranged to have a spherical form.

22. A crankcase ventilation system for an internal combustion engine comprising a crankcase, the crankcase ventilation system comprising:

a first filter arrangement arranged for cleaning a crankcase gas generated during operation of the internal combustion engine, the first filter arrangement comprising a filter element of an oleophobic type for cleaning the crankcase gas, a temperature altering device for cooling a temperature of the crankcase gas towards a desired temperature, at which the first filter arrangement is adapted for an efficient cleaning, wherein:

the crankcase ventilation system is configured to recirculate the crankcase gas through the first filter arrangement, and the crankcase ventilation system further comprises a controllable valve mechanism configured to adjust a level of crankcase gas recirculation based on a crankcase gas pressure.

23. The crankcase ventilation system according to claim 22, wherein the controllable valve mechanism is configured to be controlled based on the crankcase gas pressure in the crankcase.

* * * * *